US007753743B2

(12) United States Patent
Yang et al.

(10) Patent No.: US 7,753,743 B2
(45) Date of Patent: Jul. 13, 2010

(54) ELECTRICAL CONNECTOR HAVING RETAINER FOR SECURING TERMINALS DISPOSED THEREIN

(75) Inventors: Guo-Hua Yang, KunShan (CN); Chin-Te Lai, TuCheng (TW); Su-Feng Liu, KunShan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/586,141

(22) Filed: Sep. 16, 2009

(65) Prior Publication Data

US 2010/0068941 A1 Mar. 18, 2010

(30) Foreign Application Priority Data

Sep. 16, 2008 (CN) ..... 2008 1 0304502

(51) Int. Cl.
*H01R 13/514* (2006.01)

(52) U.S. Cl. ..... 439/752

(58) Field of Classification Search ..... 439/101, 439/92, 655, 595, 752, 352
See application file for complete search history.

(56) References Cited

U.S. PATENT DOCUMENTS 7,318,749 B2 * 1/2008 Li et al. ..... 439/580

FOREIGN PATENT DOCUMENTS

CN 200520071603 * 7/2006

* cited by examiner

*Primary Examiner*—Javaid Nasri
(74) *Attorney, Agent, or Firm*—Wei Te Chung; Andrew C. Cheng; Ming Chieh Chang

(57) ABSTRACT

An electrical connector (100) includes an insulative housing (2) having a main portion (21) and a tongue portion (22) extending forwardly from the main portion; a terminal (4) received in the insulative housing; and a retainer (5) includes a beam (51) and two locking members (52) extending forwardly from opposite ends of the beam, the two locking members latching with the main portion, and the beam pressing against the terminal.

11 Claims, 7 Drawing Sheets

ELECTRICAL CONNECTOR HAVING RETAINER FOR SECURING TERMINALS DISPOSED THEREIN

FIELD OF THE INVENTION

The present invention relates to an electrical connector, and more particularly to an electrical connector having a retainer secured to a rear end of a housing so as to prevent contact terminals from escaping.

DESCRIPTION OF PRIOR ART

As it well known to those in the art, terminals attached within a housing have to be securely arranged so as to avoid unwanted withdrawal from the housing during mating and unmating. Different retaining means has been used to enhance engagement between the terminals and the insulative housing. For example, CN Pat. No. 200520071603 issued on Jul. 26, 2006 to Li discloses a power connector having an insulative housing and a number of contacts assembled in the insulative housing. Retaining means, such as barbs, lances, etc. are formed on the contacts to interfere with the insulative housing.

However, in some special requirement, other retaining means is necessary to increase engagement between the insulative housing and contacts.

SUMMARY OF THE INVENTION

Accordingly, an object of the present invention is to provide an electrical connector with a retainer to securely prevent contact terminals from adversarial withdrawal during mating and unmating.

In order to achieve the object set forth, an electrical connector in accordance with the present invention comprises an insulative housing having a main portion and a tongue portion extending forwardly from the main portion; a terminal received in the insulative housing; and a retainer includes a beam and two locking members extending forwardly from opposite ends of the beam, the two locking members latching with the main portion, and the beam pressing against the terminal.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
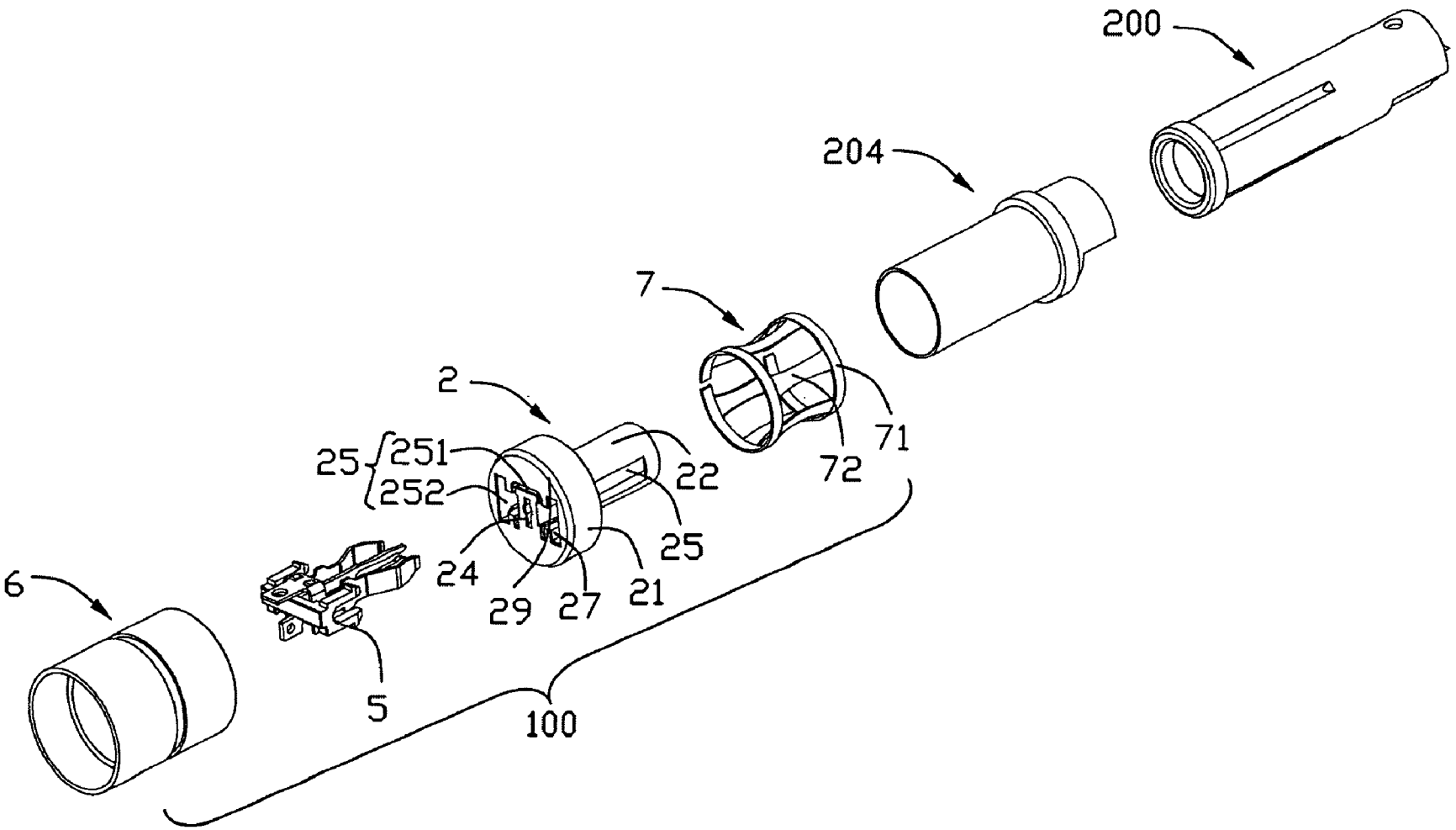
FIG. 1 is an exploded, perspective view of an electrical connector.
Figure 2:
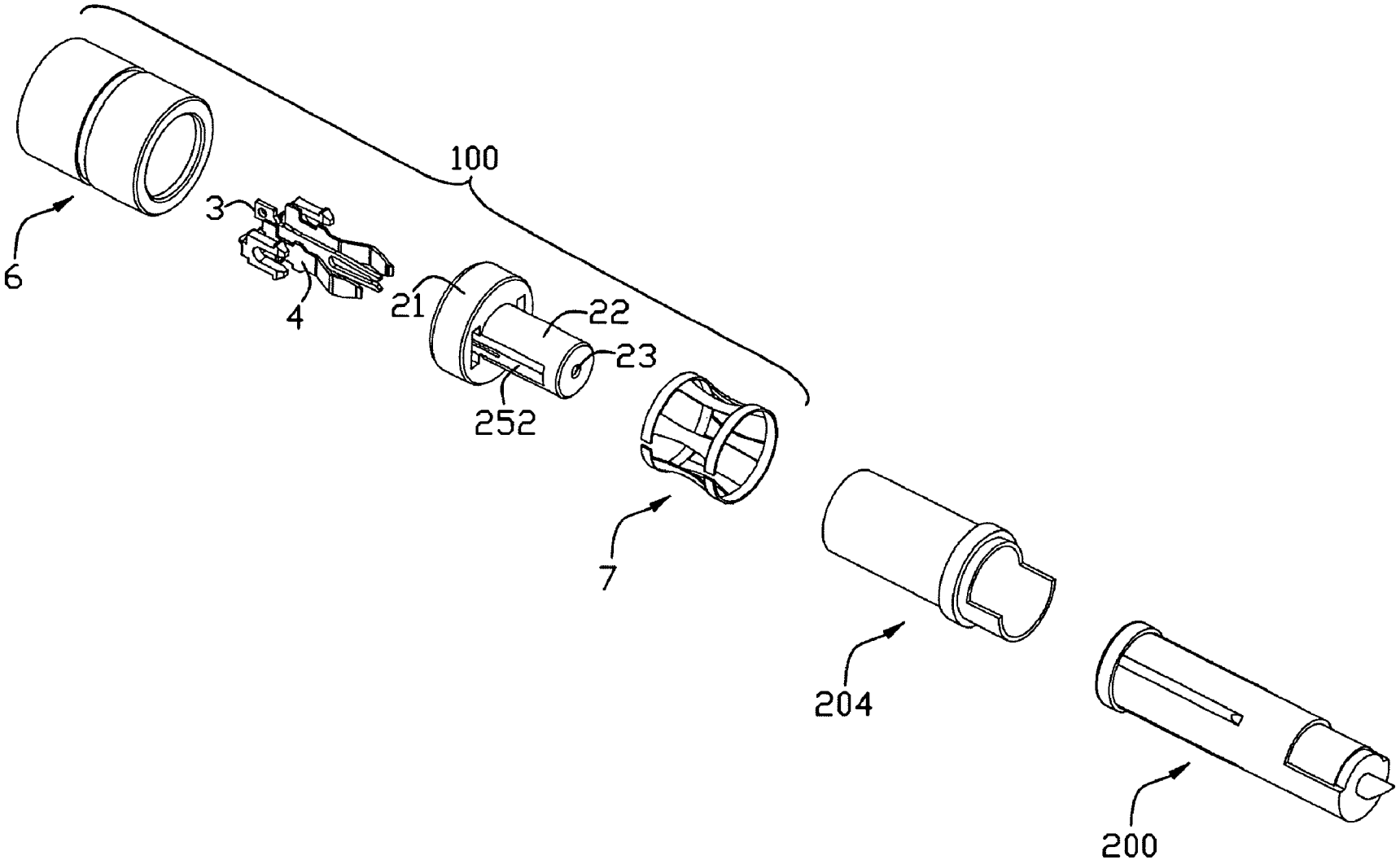
FIG. 2 is similar to FIG. 1, but viewed from another aspect.
Figure 3:
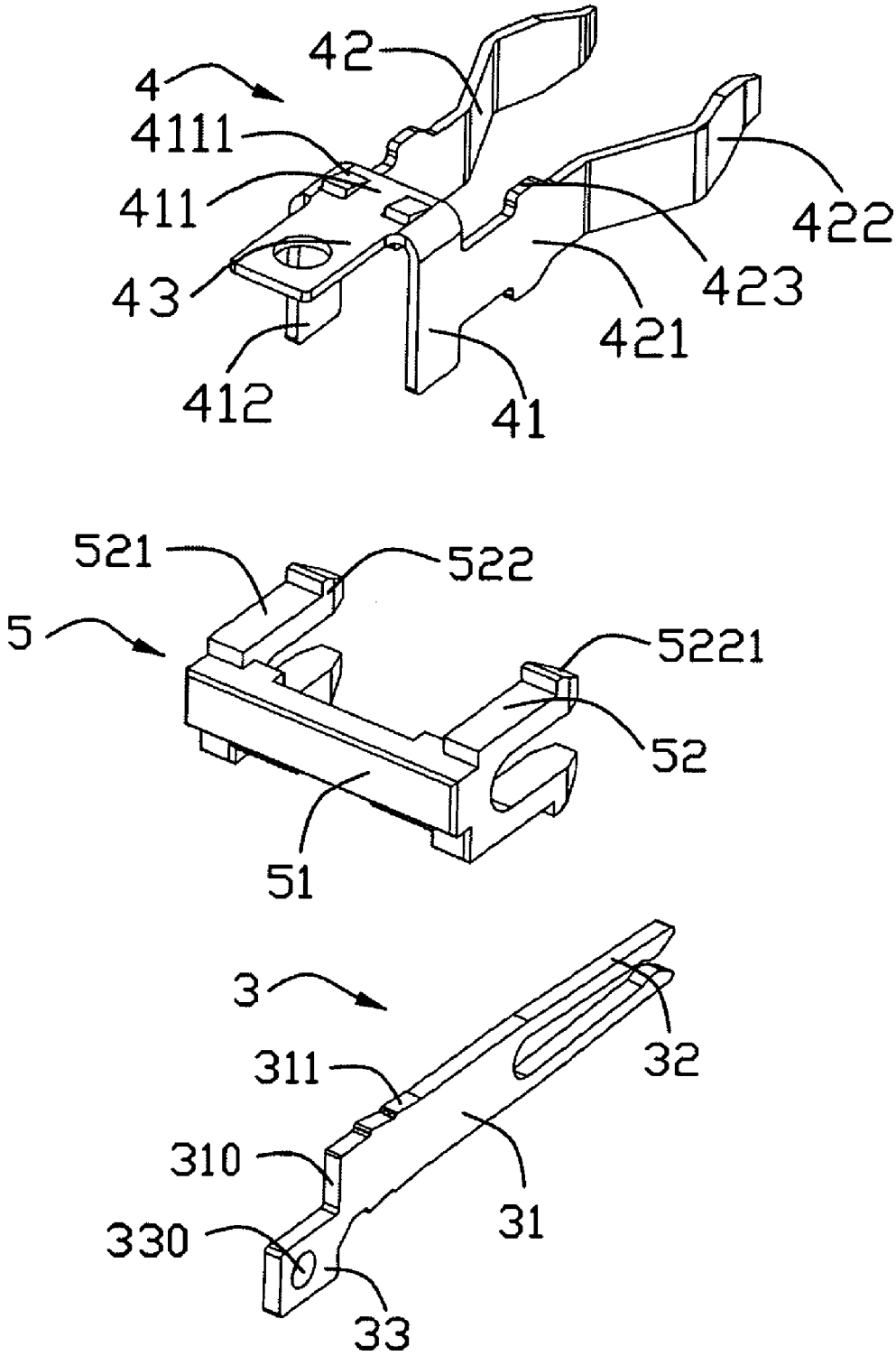
FIG. 3 is an enlarged view of a retainer and contacts.
Figure 4:
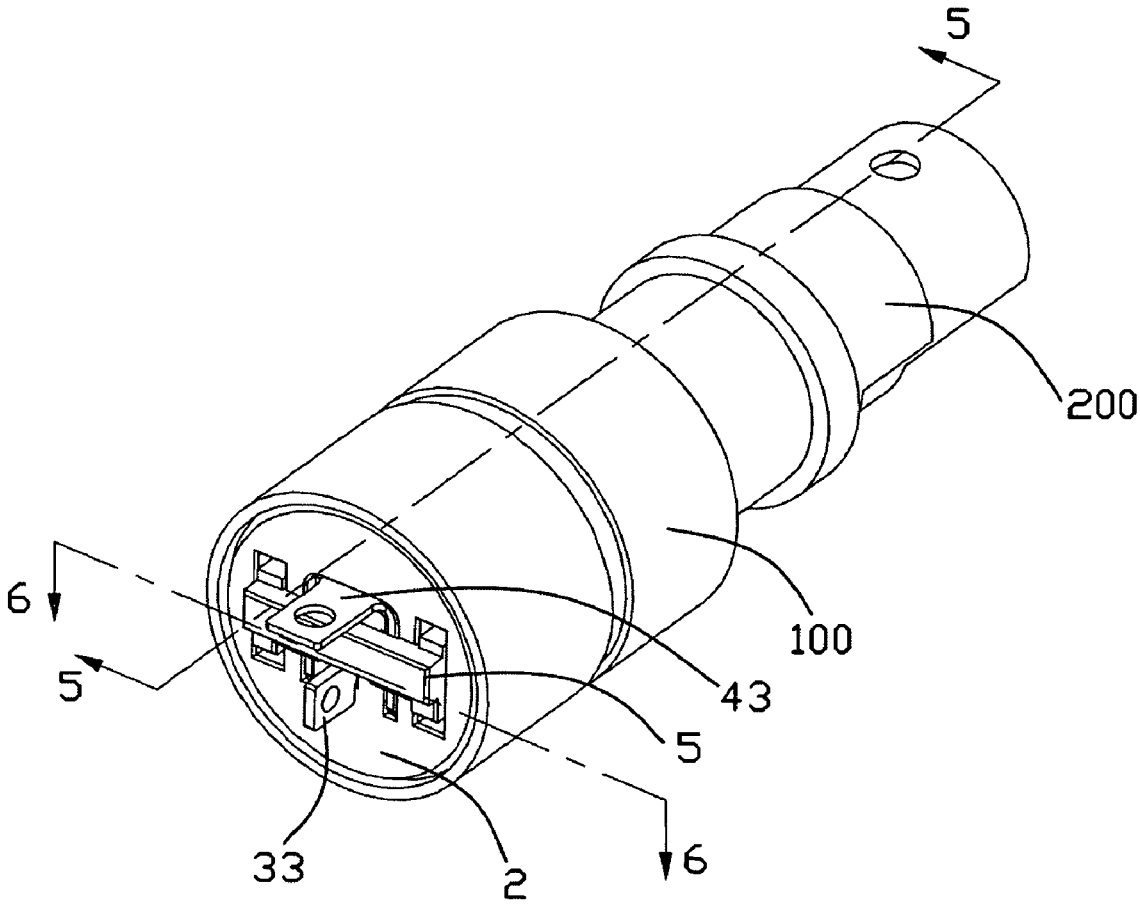
FIG. 4 is an assembled, perspective view of the electrical connector.
Figure 5:
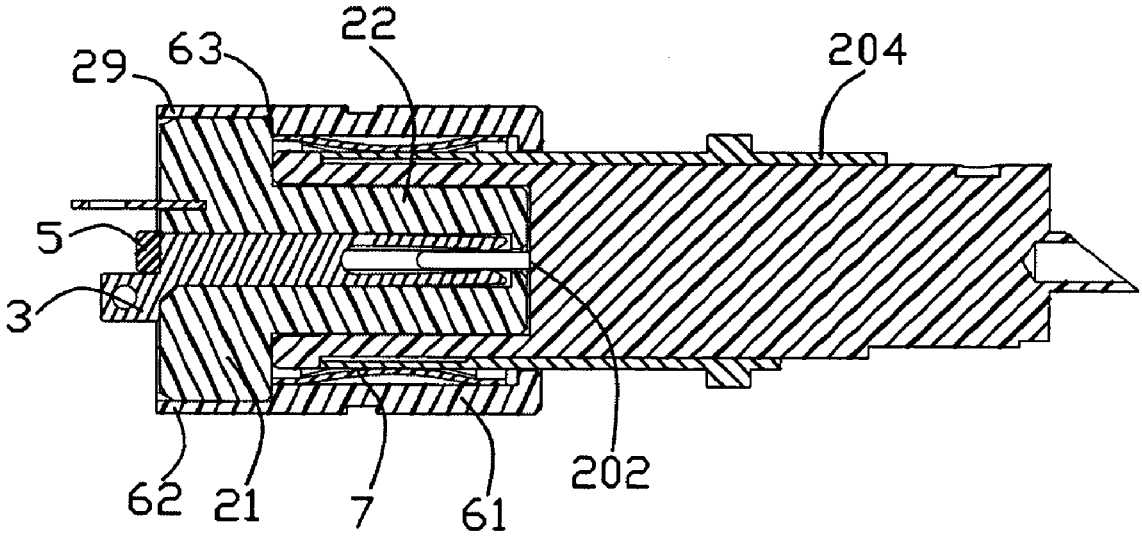
FIG. 5 is a cross-section view taken along line 5-5 of the FIG. 4.
Figure 6:
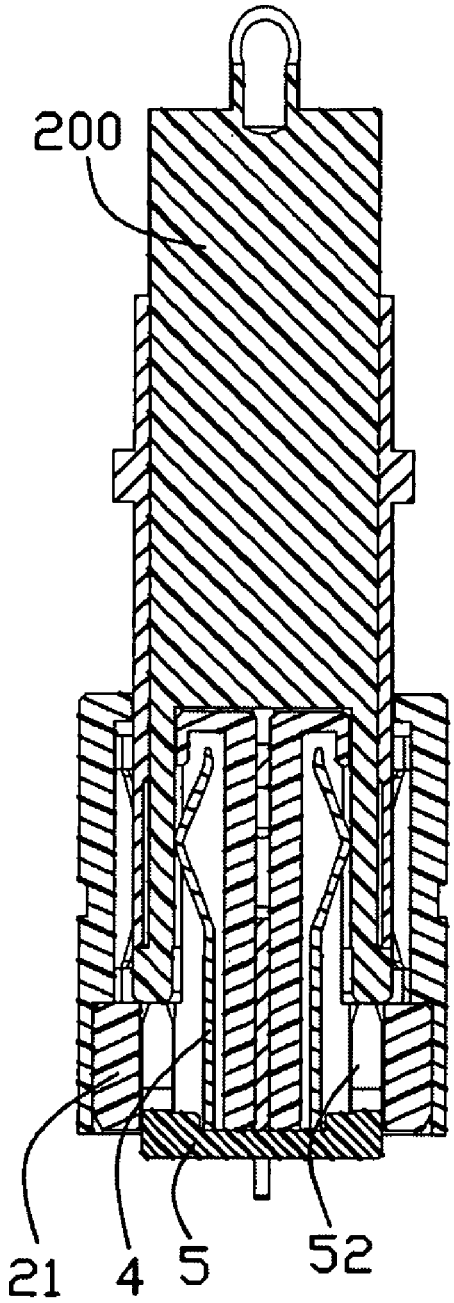
FIG. 6 is a cross-section view taken along line 6-6 of the FIG. 4.
Figure 7:
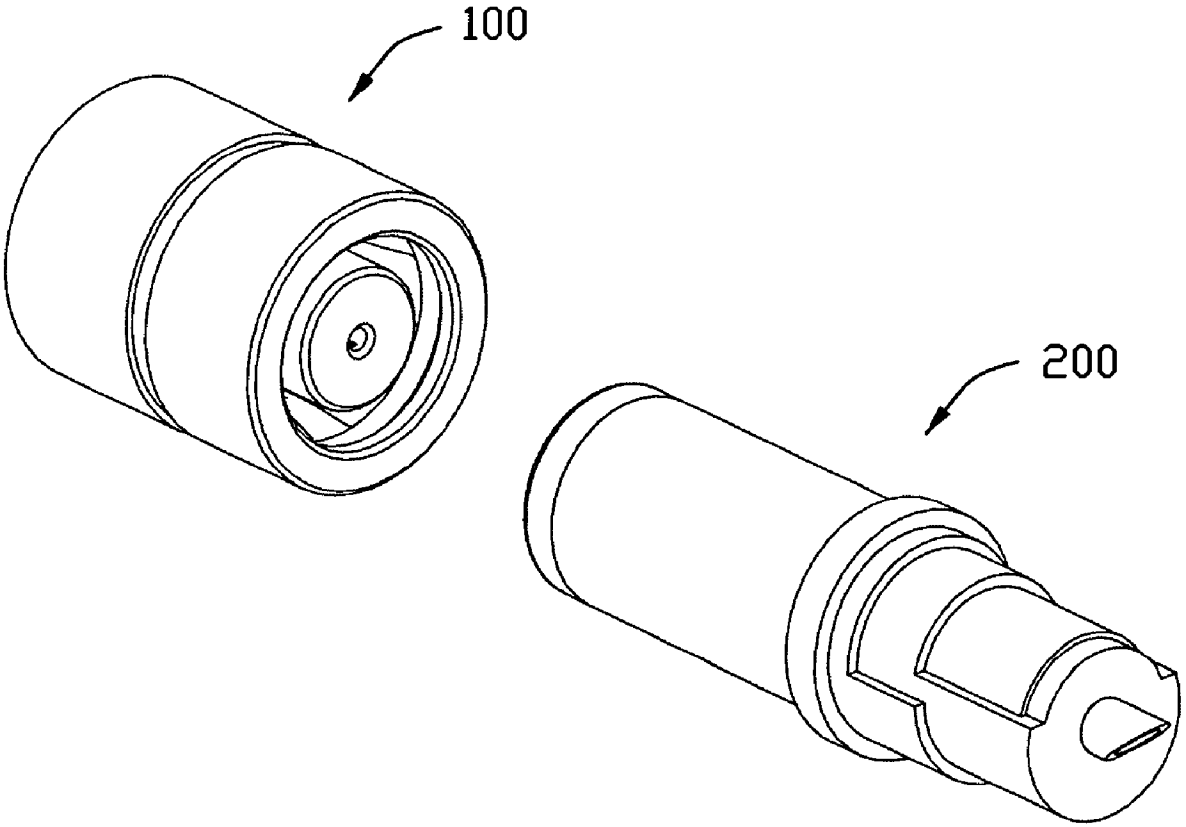
FIG. 7 shows the electrical connector and a complementary connector.

Referring to FIGS. 1-7, an electrical connector 100 comprises an insulative housing 2, a number of terminals mounted to the insulative housing 2 from a rear surface thereof, a retainer 5 attached to the rear surface of the housing 2 for positioning the contacts, a cover 6 shielding the insulative housing 2 and a grounding member 7 mounted to the cover 6.

The contacts includes a first terminal 3 and a second terminal 4. The first terminal 3 is made of metallic sheet and located in a vertical plane. The first terminal 3 includes a retention portion 31, a contacting portion 32 extending forwardly from the retention portion 31, and a tail portion 33 connecting to a lower section of a back side of the retention portion 31. A plurality of barbs 311 are formed on an upper side and a bottom side of the retention portion 31, therefore, the first terminal 3 can be secured in the insulative housing 2 reliably. The contacting portion 32 is of fork-shaped for receiving a corresponding contacting element of the complementary connector 200. The tail portion 33 is disposed in a position lower than the retention portion 32, and a hole 330 is defined therein.

The second terminal 4 includes an inverted U-shaped base portion 41, a pair of flexible arms 42 extending forwardly form two side portions 412 of the base portion 41, and a connecting portion 43 projecting rearwardly from a top side 411 of the base portion 41. Two tabs 4111 are formed on the top side 411. The elastic arm 42 includes a body portion 421 and a curved mating portion 422 protruding forwardly from the body portion 421. Two tabs 423 are formed on a top and bottom sides of the body portion 421.

The retainer 5 is made of insulative material, and comprises a horizontal beam 51 and two locking members 52 extending forwardly from opposite ends of the beam 51. Each locking member 52 includes two deformable arms 521 spaced apart from each other along the vertical direction. Two hook portions 522 are formed at free ends of the two arms 521, respectively. Each hook portion 522 has a wedged guiding end 5221.

The insulative housing 2 includes a cylindrical shaped main portion 21 and a tongue portion 22 extending forwardly from the main portion 21. However, the base portion and the tongue portion 22 may be rectangular shape, or other contour. A circular shaped slot 23 is defined through the main portion 21 and tongue portion along a front-to-back direction. The slot 23 is used for accommodating a corresponding contact 202 of the complementary connector 200. A first contact passage 24 is defined in the main portion 21, aligning with and in communication with the slot 23. The first terminal 31 is received in the first contact passage 24 and further extends into the slot 23 to engaging with the corresponding contact 202 of the complementary connector 200. A second terminal passage 25 is defined in the insulative housing 2 to accommodate the second terminal 4. The second terminal passage 25 includes a horizontal groove 251 defined in the main portion 21 and two longitudinal grooves 252 defined in the main portion 21 and peripheral side of the tongue portion 22. The longitudinal groove 252 has different widths in the main portion 21 and the tongue portion 22 along a front-to-back direction. Two mounting cavities 27 are defined in the main portion 21, arranged outside of and in communication with the longitudinal grooves 252, respectively.

The second terminal 4 is inserted into the second terminal passage 25, with the arms 42 accommodated in front part of the longitudinal grooves 252 of the second terminal passage 25, the base portion 41 received in the horizontal groove 251 and rear part of the longitudinal grooves 252.

The retainer 5 is assembled to the base portion 21, with the two locking members 52 inserted into the mounting cavities 27 and the hook portions 5221 latching with a front surface of the base portion 21. The beam 51 abuts and presses against back surfaces of the two side portions 412 and a back edge 310 of the retention portion 31. The tail portion 33 and the connecting portion 43 are disposed above and below the beam 51, respectively. The two side portions 412 of the base portion 41 are disposed between the two locking members 52 of the retainer 5.

The shell 6 is made of metallic material, and has a front portion 61 and rear portion 62. The front portion 61 is thicker than the rear portion 62, with a step 63 formed at a border therebetween. The insulative housing 2 is assembled to the shell 6 along a front-to-back direction, until the main portion 21 abutting against the step 63 of the shell 6. A chamfer 29 is defined in a rear edge of the shell 6, and such configuration facilitates inwardly bending rear edge of the shell 6 to prevent the insulative housing 2 sliding away from the shell 6. A receiving space is formed between the front portion 61 and tongue portion 22 for accommodating corresponding portion of the complementary connector 200.

A grounding member 7 includes two rings 71 spaced apart from each other along an axial direction and a number of curved strips 72 spaced apart each other along a radial direction and further connecting to the two rings 71. The grounding member 7 is assembled to an interior of the front portion 61 of the shell 6 and abuts an inner side of the front portion 61. The grounding member 7 further surrounds the tongue portion 22 of the insulative housing. When the complementary connector 200 mates with the electrical connector 100, a metallic shell 204 of the complementary connector 200 firstly contacts the strips 72 of the grounding member 7 to achieve grounding function. In addition, as the strips 72 deflect toward the metallic shell 204 and press onto thereon, which may provide retention means between the electrical connector 100 and the complementary connector 200.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising: an insulative housing having a main portion and a tongue portion extending forwardly from the main portion; a terminal received in the insulative housing; and a retainer including a beam and two locking members extending forwardly from opposite ends of the beam, the two locking members latching with the main portion, the beam pressing against the terminal; wherein each locking member includes two deformable arms spaced apart from each other along a vertical direction; wherein a hook portion is formed at a free end of the arm and latches with a front surface of the main portion; wherein the terminal includes a U-shaped base portion and a pair of elastic arms extending forwardly from two side portions of the base portion; wherein the two side portions of the base portion are located in front of the beam of the retainer; wherein the two side portions of the base portion are disposed between the two locking members of the retainer.

2. The electrical connector recited in claim 1, wherein the terminal has a connecting portion projecting rearwardly from a top side of the base portion.

3. The electrical connector recited in claim 1, wherein the connecting portion is located above the beam of the retainer.

4. The electrical connector recited in claim 1, further comprising another terminal arranged in a vertical plane.

5. The electrical connector recited in claim 4, wherein the another terminal includes a retention portion, a contacting portion extending forwardly from the retention portion, and a tail portion connecting to a rear lower section of the retention portion.

6. The electrical connector recited in claim 5, wherein the beam presses against a back side of the retention portion.

7. The electrical connector recited in claim 5, wherein the contacting portion of the another terminal is fork-shaped.

8. The electrical connector recited in claim 1, further comprising a metallic shell enclosing the insulative housing.

9. The electrical connector recited in claim 8, wherein the shell has a step formed in an interior thereof abutting against the main portion.

10. The electrical connector recited in claim 8, wherein a grounding member is mounted to an interior of the shell and surrounds the tongue portion of the insulative housing.

11. The electrical connector recited in claim 10, wherein the grounding member includes two rings spaced apart from each other along an axial direction and a number of curved strips connecting to the two rings and spaced apart from each other along a radial direction.

* * * * *